US005246290A

United States Patent [19]

Bolz

[11] Patent Number: 5,246,290

[45] Date of Patent: Sep. 21, 1993

[54] CONE MIXER WITH SWIVEL ARM DRIVE AND SEALING ARRANGEMENT LUBRICATED BY AN EXTERNAL LUBRICANT RECEPTACLE

[75] Inventor: Alfred Bolz, Wangen/Allgäu, Fed. Rep. of Germany

[73] Assignee: Alfred Bolz GmbH & Co. Kg, Wangen/Allgau, Fed. Rep. of Germany

[21] Appl. No.: 893,460

[22] Filed: Jun. 4, 1992

[30] Foreign Application Priority Data

Jun. 6, 1991 [DE] Fed. Rep. of Germany ..... 4118592

[51] Int. Cl.[5] ..... B01F 7/14

[52] U.S. Cl. ..... 366/287; 277/15; 277/17; 366/331

[58] Field of Search ..... 277/15, 17, 18, 71; 384/398, 473, 484; 366/64, 65, 96–98, 100, 241, 279, 281–283, 287, 288, 331, 349

[56] References Cited

U.S. PATENT DOCUMENTS

| | | | |
|---|---|---|---|
| 3,591,188 | 7/1971 | Eisner | 277/15 X |
| 4,422,772 | 12/1983 | Baumgartner | 366/287 |
| 4,588,301 | 5/1986 | Bolz | 277/71 X |

FOREIGN PATENT DOCUMENTS

| | | | |
|---|---|---|---|
| 0042588 | 6/1981 | European Pat. Off. . | |
| 6904388 | 2/1969 | Fed. Rep. of Germany . | |
| 2643769 | 3/1978 | Fed. Rep. of Germany . | |
| 3100309 | 1/1986 | Fed. Rep. of Germany . | |
| 350871 | 9/1986 | Fed. Rep. of Germany | 366/287 |
| 3622027 | 1/1988 | Fed. Rep. of Germany | 366/65 |
| 3045855 | 10/1989 | Fed. Rep. of Germany . | |
| 89045009 | 6/1990 | Fed. Rep. of Germany . | |
| 2016621 | 5/1970 | France . | |

*Primary Examiner*—Harvey C. Hornsby
*Assistant Examiner*—Charles Cooley
*Attorney, Agent, or Firm*—Brown, Martin, Haller & McClain

[57] ABSTRACT

A cone dryer with swivel arm drive and sealing arrangement consists of a conic mix receptacle with an upper housing cover having in its center a drive arrangement aligned with the receptacle axis which drives the swivel arm around the receptacle axis and which also drives the mixing screw rotating on the free pivoting end of the swivel arm. A first sealing and lubricating package supplies the upper bearing of the pivot arm on the center side, and a second sealing and lubricating package supplies the bearing of the mixing screw on the swivel arm side. For the simultaneous supply of both sealing and lubricating packages, the sealing and lubricating package on the center side and the sealing and lubricating package on the swivel arm side are connected with one another via ducts, and both sealing packages are supplied with fluid via a common receiver receptacle arranged outside the mixer.

8 Claims, 3 Drawing Sheets

CONE MIXER WITH SWIVEL ARM DRIVE AND SEALING ARRANGEMENT LUBRICATED BY AN EXTERNAL LUBRICANT RECEPTACLE

BACKGROUND OF THE INVENTION

The present invention relates to a cone mixer having a conic mix receptacle and a swivel arm driven around the receptacle axis.

Such cone dryers or cone mixers are used primarily in pharmaceutics but also in the food industry and the chemical industry.

The problem with such cone dryers and cone mixers is the fact that two different drive motors and associated drives on the one hand rotate the swivel arm around the receptacle axis, on the other rotate the mixing screw rotating in the swivel arm. Based on older patents of the petitioner the drive motors and associated drives are arranged on the receptacle cover and a hollow shaft is run through the receptacle cover whereby the drive arrangement mentioned earlier takes over the drive of the swivel arm and of the mixing screw.

In other words, there is a total of two gear arrangements to be lubricated and monitored, i.e. the gear of the drive set- up in the receptacle center on the receptacle cover, and the pivot gear of the mixing screw in the swivel arm housing.

These bearing sites are separated from one another in space and each bearing site is associated in a known fashion with a lubrication arrangement for lubricating the slip rings, and with a product barrier chamber if any. With the lubrication arrangement for lubricating the slip rings, the slip rings ought to be lubricated constantly during the operation of the cone screw mixer whereby the lubrication arrangement ought to be such that the lubricating liquid does not penetrate into the receptacle and cannot soil the product. To this effect, product barrier chambers are known that prevent the lubricating liquid for the slip rings to reach into the product space.

However, such arrangements are known only in agitator receptacles, i.e. receptacles which do not operate with a swivel arm and a mixing screw rotating therein.

However, significant difficulties arise as soon as a cone dryer or a cone mixer is to be equipped with such a bearing and sealing arrangement.

Indeed, it is especially difficult to equip with a slip ring lubrication and a product barrier chamber the bearing and sealing unit in the upper area of the swivel arm housing in which the mixing screw rotates. When the mixing screw itself is driven in a rotating manner and the swivel arm rotates around the receptacle axis, this involves revolving gear arrangements which are difficult to access from the outside. Until now it is known that a receiver receptacle is arranged on the revolving swivel arm and in which the slip ring lubricating fluid is present. However, this offers the disadvantage that this receptacle must be contained in the product area and that as a result there is the danger of the slip ring lubricating fluid escaping from the receptacle if damaged and of soiling the product. There is also an undesirable clearing space as a result of arranging this receptacle with the outside ducts. In addition, a lubricant check of the receptacle arranged in the product area is not possible during the operation of the cone dryer or mixer.

In addition, it has not been possible until now to arrange a product barrier chamber in the bearing unit between the mixing screw and the swivel arm housing.

The task of the present invention therefore is to further develop a cone dryer or mixer of the type mentioned earlier so that the bearing and sealing arrangement between the mixing screw and the swivel arm housing is provided by a lubricating receptacle accessible from the outside.

An essential feature of the present invention is that the outside receiver receptacle provides for a concurrent lubrication of the central bearing and sealing arrangement on the housing cover in connection with the sealing arrangement revolving with the swivel arm between the swivel arm and the mixing screw.

In other words, the present invention proposes a duct system which supplies the central bearing and sealing unit in the receptacle center as well as concurrently the bearing and sealing unit in the swivel arm housing in which the mixing screw rotates.

This offers the distinct advantage that an outside receiver receptacle can now be used which supplies simultaneously and synchronously both of the sealing and bearing arrangements referred to above. This makes it possible for the first time to monitor and to guarantee the tightness of the bearing of the swivel arm and of the bearing of the mixing screw together during operation.

SUMMARY OF THE INVENTION

In a further development of the present invention, not only both of the bearing and sealing units are supplied with a slip ring lubricating liquid but also corresponding product barrier chambers are arranged whereby one product barrier chamber is arranged in the central upper sealing and bearing arrangement in the receptacle center and another product barrier chamber in the bearing and sealing arrangement on the mixing screw side.

As a result, it is possible to satisfy more rigid security requirements because the escape of slip ring lubricating fluid into the product space is prevented altogether through the arrangement of such product barrier chambers. As a result, a dryer or mixer in accordance with the invention can also be used for the pharmaceutical or food industries and features an exceptionally high operating safety.

In accordance with the invention, rotation seals are used whereby such rotation seals are present in the bearing and sealing arrangement on the center-side as well as in the bearing and sealing arrangement on the mixing screw side.

Such rotation seals ensure that the slip ring lubricating fluid supplies the slip ring seals. In other words, in accordance with the invention there is a duct line for the duct pairs for the supply of slip ring lubricating fluid and for the supply, if any, with barrier air or barrier gas for the product barrier chambers in the swivel arm housing.

To this effect, the duct pairs are first fed into the fixed part of the central drive unit on the receptacle cover side, then taken between rotation seals, and finally through a further duct pair taken to the bearing and sealing arrangement on the mixing screw side at the exit of the rotation seals. It is important that these duct pairs are supported in the swivel arm housing which offers the advantage that no outside ducts are arranged in the product area. Such outside ducts are disadvantageous then there is the risk that product deposits on these ducts or that the liquid contained in the duct escapes when such ducts break and soils the product.

However, it would be possible to run such ducts also through the center of the central hollow shaft arranged in the drive arrangement on the receptacle cover side and known from previous patents of the petitioner. However, such a central running of ducts through this hollow shaft is a disadvantage when this hollow shaft is needed for running other media, such as a spray medium with which a spray medium is to be introduced into the product area or when this central hollow shaft is needed for running a mixing screw heater.

Accordingly, the invention proposes to run duct pairs in the swivel arm housing outside the central hollow shaft so that they supply the bearing and sealing arrangement on the receptacle cover side as well as the bearing and sealing arrangement on the mixing screw side. The foregoing description assumed the use of a liquid as slip ring lubricating medium. The present invention also applies if a lubricating gas (e.g. a hydrogen gas) is used instead of the lubricating liquid. The further description also assumes the use of a gas as barrier medium for the product barrier chambers. In the framework of the present invention, a liquid can also be used instead.

Instead of the slip ring seals described here which operate in essence in an axial manner, radial seals can also be used instead—which is also part of the present invention. Of importance in the present invention is the technical theory whereby one and the same slip ring lubricating fluid supplies the bearing and sealing arrangement on the receptacle center side as well as the bearing and sealing arrangement on the mixing screw side in the same duct system.

Object of the present invention is not only the result of the object of the individual patent claims but also of the combination of individual patent claims. All features and characteristics disclosed in the documentation—including the summary—in particular the arrangement shown in the drawings are claimed as essential to the invention to the extent that jointly or severally they are new in terms of existing technology.

The following is a more detailed description of the invention through drawings which illustrate several variants. The drawings and their descriptions disclose additional essential characteristics and advantages of the invention.

DESCRIPTION OF THE PREFERRED EMBODIMENTS

For reasons of clarity, the following description refers only to a cone dryer even though the design as cone dryer as well as cone mixer are claimed as integral parts of the present invention.

Figure 1:
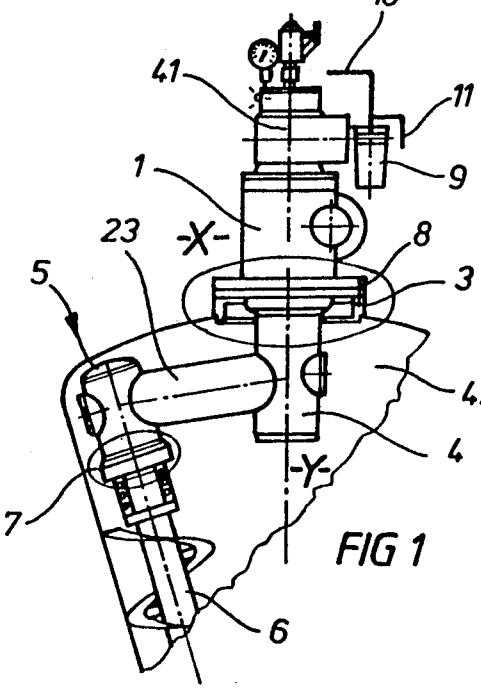
FIG. 1 is a partial view of a mixer-dryer unit.

In the cone dryer mixer unit of FIG. 1 two drive motors are superimposed with their associated drives in the receptacle axis 41 whereby the exact bearing arrangement and its composition is known through previous patents of the same petitioner. The publication of these patents in its entirety is part of the present publication.

The upper part of the drive unit 1 features a receiver receptacle 9 which features an intake 10 and an outflow 11.

The entire drive unit 1 rests on the receptacle flange 3 and is sealed and supported through a sealing package 8. On the inside of the receptacle in the receptacle axis 41 is a centered swivel arm housing 4 which together with a connecting arm 23 comprises the swivel arm 5. In the upper area of the swivel arm 5 the mixing screw 6 rotates and is sealed and supported in a sealing package 7.

Figure 2:
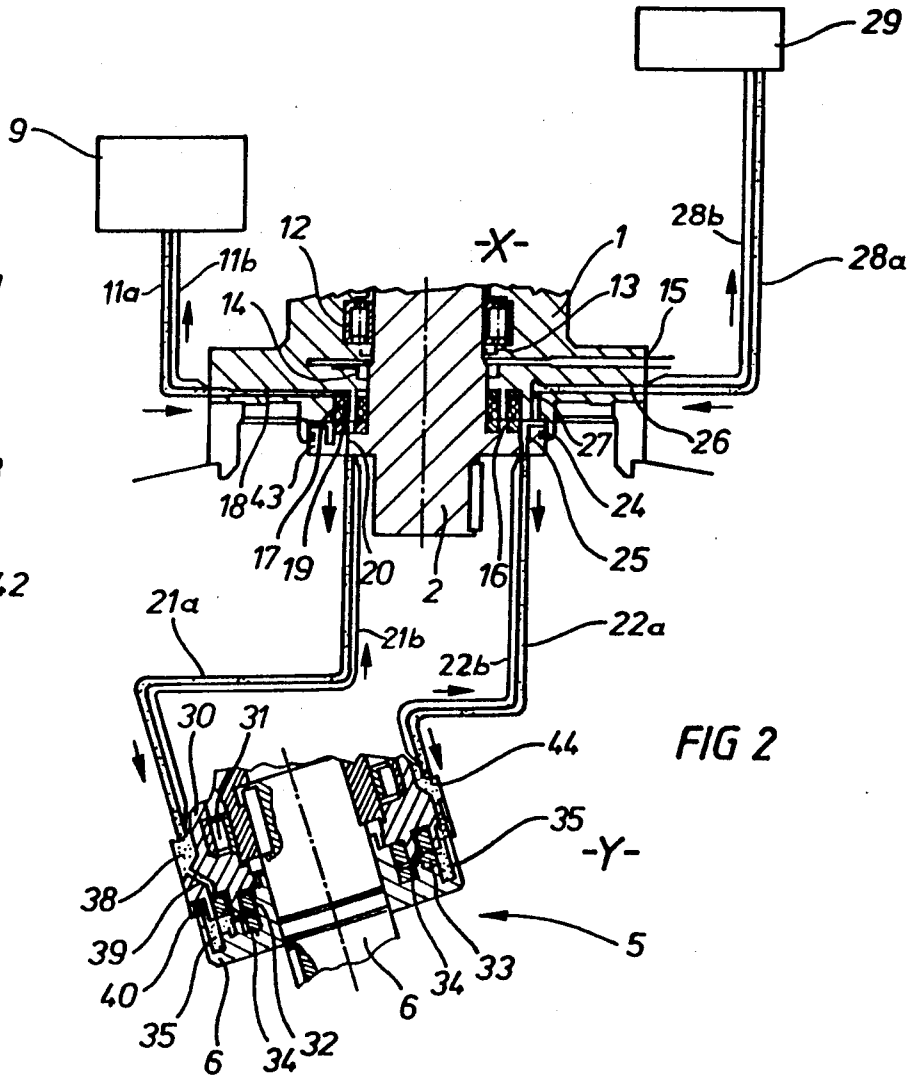
FIG. 2 is a sectional view of areas X and Y in accordance with FIG. 1.
Figures 3, 4:
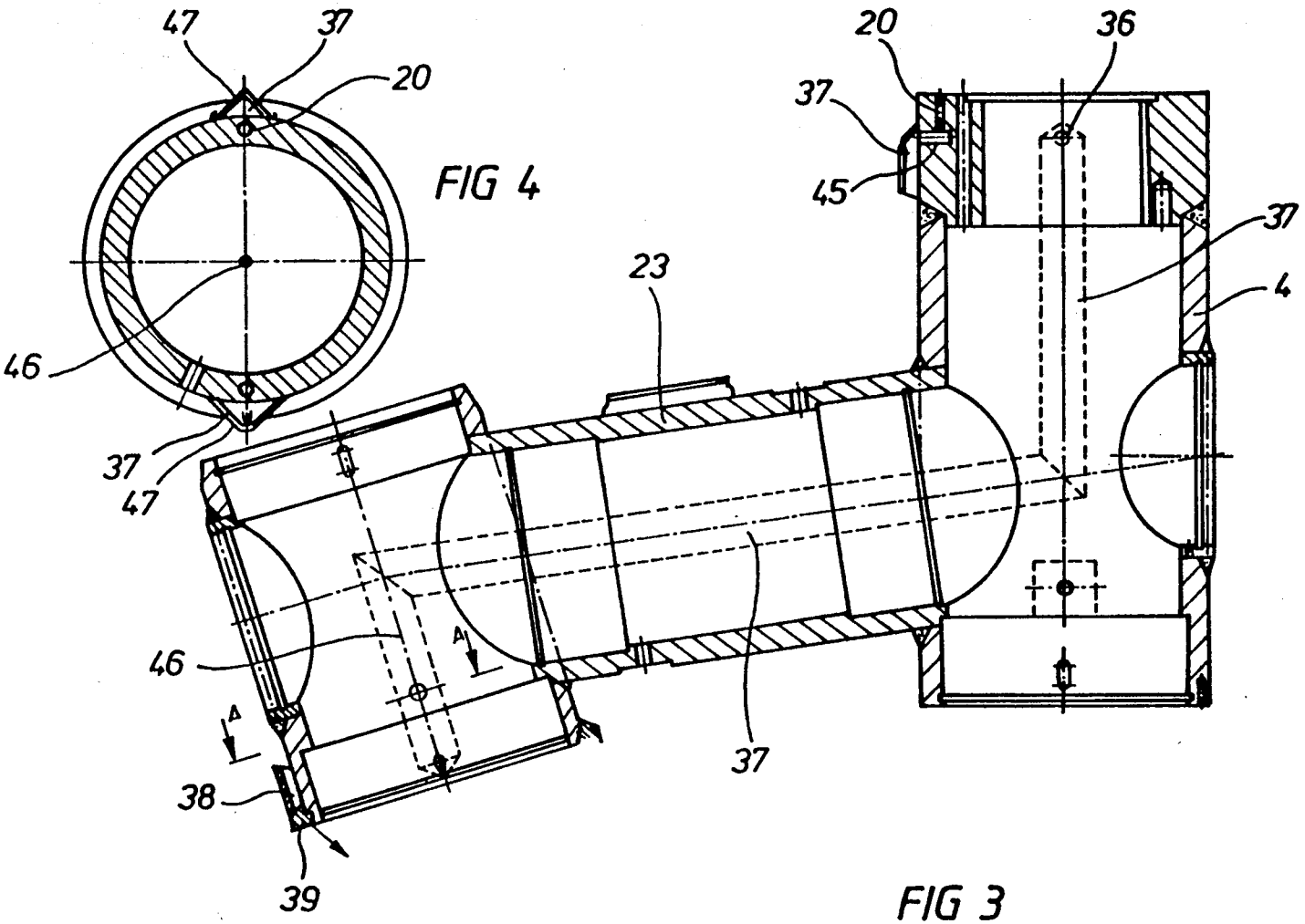
FIG. 3 shows a section of the swivel arm.
FIG. 4 is a section through the swivel arm along the line A—A in FIG. 3.

FIG. 2 is a diagram of the duct guide whose design is shown in greater detail in accordance with FIG. 3.

First, it must be pointed out that a hollow shaft 2 starts from the drive unit 1 and rotates the swivel arm 5 around the receptacle axis 41.

In the drive unit 1 the slip ring lubricating fluid is fed from the receiver receptacle 9 via the lubricating fluid outflow duct 11*a* 11 into a cross bore 18 and reaches into the intermediate area between two inner and outer slip ring seals 16, 17 at a radial distance from one another.

The inner slip ring seal 16 sits radially inside on the hollow shaft and is an additional protection that the lubricating medium cannot enter the product area 42 from the bearing 12.

In addition, a further safety measure is a so-called safety barrier chamber which consists in essence of a cross bore 15 arranged between the bearing 12 and below a seal 13.

Underneath the cross bore 15 is another seal 14 for the protection of other seals 16, 17 below.

Each of the slip ring seals 16, 17 consists of a fixed slip ring lubricated through the arrangement described hereafter as well as a revolving ring arranged in a cross flange 43 of the hollow shaft 2.

In other words, the slip ring lubricating fluid is introduced via the cross bore 18 into an annular channel 19 arranged in the stationary part and supplies the slip ring seals 16, 17.

In the revolving part, in the area of the cross flange 43, is arranged a connecting bore 20, in whose area the lubricating fluid is collected and contained. A lubricating fluid supply duct 21*a* receives the lubricating fluid from connecting bore 20 and supplies the lubricating fluid to lower sealing package 7. After the lubricating fluid flows through lower sealing package 7, as described below, it returns to upper sealing package 8 via a lubricating fluid return duct 21*b* and, in turn, to receptacle 9 via a lubricating fluid intake duct 11*b*.

A product barrier medium receptacle 29 feeds product barrier medium to upper sealing package 8 via a product barrier medium outflow duct 28*a*. For sealing the slip ring seals 16, 17 there is a radial external annular chamber 25 separated through the packing washer 24 on the product side and connected to a duct pair 28 via a longitudinal bore 27 and a corresponding cross bore 26 which receives product barrier medium from outflow duct 28*a*.

The annular chamber 25 as well is contained on the revolving part (cross flange 43 of hollow shaft 2) in the area of the annular chamber 25 and ends in a barrier medium supply duct 22*a*, which receives the product barrier medium from connecting bore 20 and supplies the barrier medium to lower sealing package 7. After the barrier medium flows through lower sealing package 7, it returns to upper sealing package 8 via a barrier medium return duct 22*b* and, in turn, to receptacle 29 via a barrier medium intake duct 28*b* whereby FIG. 2 only shows the lead duct for reasons of clarity.

The following is a description of the bearing and sealing arrangement (sealing package 7) on the mixing screw side.

The mixing screw 6 rotates via a bearing 31 in the swivel arm housing 30 and is sealed through slip ring seals 32, 33.

Similarly, there are the annular chambers as described through the sealing package 7.

The slip ring sealing lubricating fluid runs via the lubricating fluid supply duct 21*a* through a collecting duct 38 whereby a bore 39 leads to the annular chamber 34 beginning at the collecting duct 38.

For reasons of clarity, the drawings do not show that an annular channel is present once again at the rotating part of, the mixing screw.

A lubricating fluid return duct 21*b* starts from this annular channel which also discharges into the same annular channel connected with the connecting bore 20. This results in a completely closed system between the annular chambers of the upper slip ring seals 16, 17 and the annular chambers of the lower slip ring seals 32, 33.

Similarly, the supply with the product barrier medium takes place in the same manner.

Beginning at the annular chamber 25 the barrier medium supply duct 22*a* carries the product barrier medium via a cross bore 44 into an annular chamber 35 whereby once again the discharge duct which then returns via barrier medium return duct 22*b* the annular chamber 25 and forms a closed duct system.

FIG. 3 is a more detailed description of the design of the ducts.

The connecting bore 20 is designed as a longitudinal bore in the swivel arm housing 4 on the center-side and changes into a cross bore 45 which ends in a channel system 37 in which the ducts 21*a–b*, 22*a–b* are arranged. For reasons of clarity, FIG. 4 only shows one duct pair while the other duct pair would be offset by 90° to the duct pair mentioned above in FIG. 4.

FIG. 3 shows the channel system 37 displaced by 90° and shows that the channel system 37 stretches down in the center axis of the swivel arm housing 4, then bends at an angle of more than 90° and is carried in the connecting arm 23 where the duct system 37 bends again only to run below into the sealing package 7 parallel to the axis 46 of the mixing screw.

It is important that the entire channel system with the ducts 21*a–b*, 22*a–b* is run outside on the swivel arm housing 4 and also outside along the connecting arm 23 in order to reach the sealing package 7.

In other words, the present invention offers the advantage that outside ducts which traverse the product area are not used and that instead these ducts are welded on as profile 47 whereby such a profile pair is shown in FIG. 4 and illustrates a duct pair such as ducts 21*a–b*.

The design of the profile 47 may vary depending on application. A triangular profile may be used as shown in FIG. 4 or a semicircular profile or other geometric forms.

Figure 5:
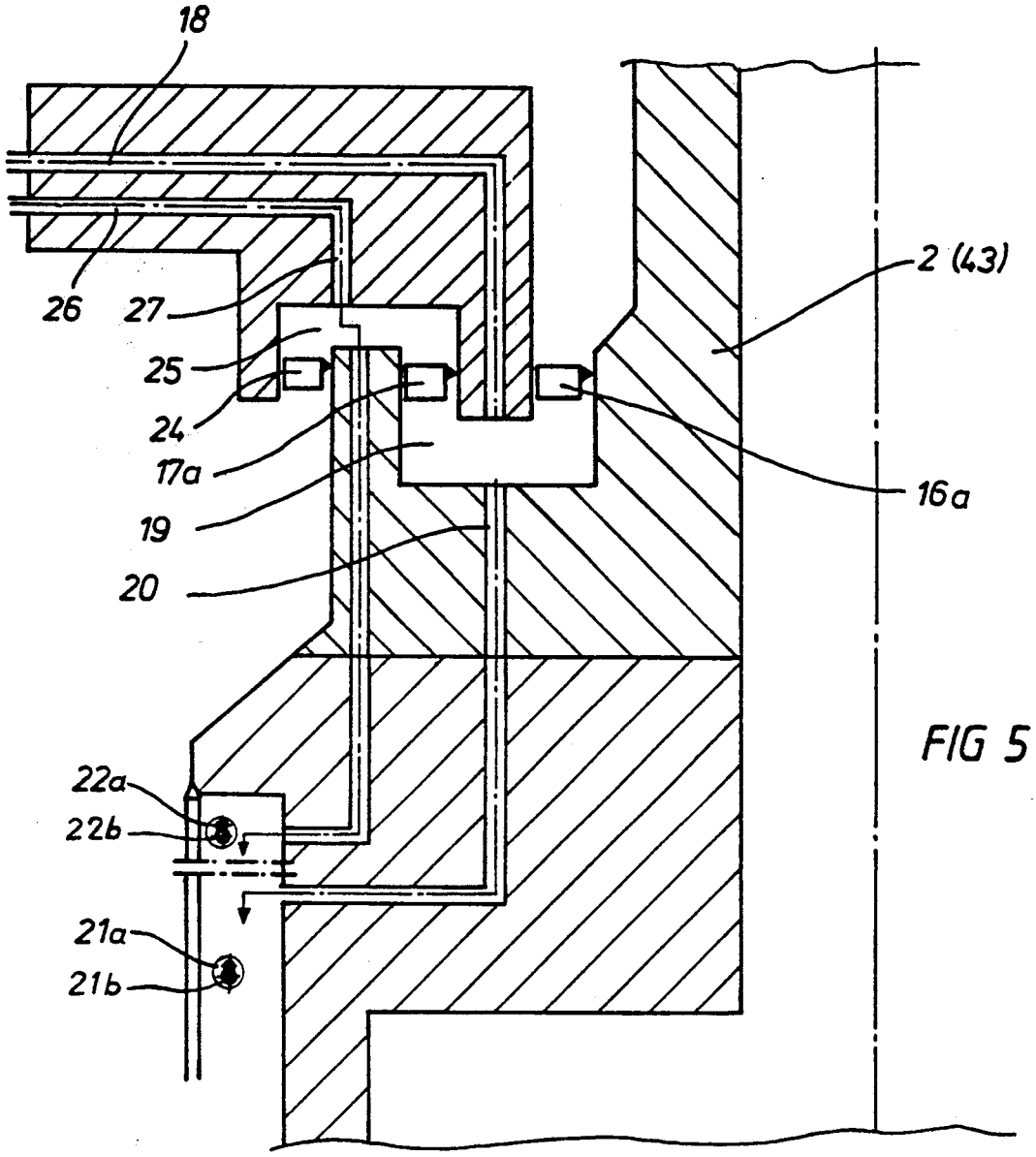
FIG. 5 is a further development of the invention whereby the slip ring seals described earlier and operating in an axial manner are replaced by radial seals.

FIG. 5 shows a similar section as shown in FIG. 2 whereby FIG. 5 shows the sealing package 8 on the center-side only and shows that the seals described before have been replaced by lubricated radial seals.

Otherwise, the same reference numerals apply to the same parts.

The slip ring seals 16, 17 as described in FIG. 2 are now replaced by corresponding radial seals 16*a*, 17*a*.

Figure 6:
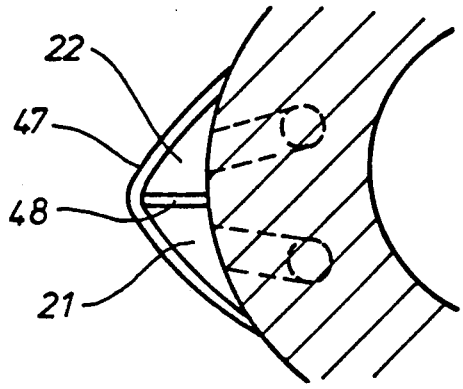
FIG. 6 is a further variant in comparison with FIG. 4 with a detailed section.

FIG. 6 shows that the profile 47 not only can be used as a channel for carrying a medium but that in the area of this profile there is a partition 48 so that in the profile 47 there are two separated duct sections whereby in the one duct section the slip ring lubricating fluid can be carried and in the other duct section the medium for the product barrier chamber.

I claim:

1. A cone mixer, comprising:

a conic mix receptacle having a receptacle axis and an upper housing cover;

a swivel arm disposed inside said conic mix receptacle, said swivel arm having a distal end and a proximal end;

drive means disposed adjacent said upper housing cover and having a drive axis collinear with said receptacle axis, said drive means connected to said proximal end of said swivel arm for rotating said swivel arm about said drive axis;

a mixing screw rotatably connected to said distal end of said swivel arm;

an upper sealing package having an upper bearing disposed at the connection between said drive means and said swivel arm, said upper bearing comprising a stationary part in rigid relation with respect to said upper housing cover and a rotating part in rigid relation with respect to said swivel arm;

a lower sealing package having a lower bearing disposed at the connection between said swivel arm and said mixing screw, said lower bearing comprising a stationary part remaining in rigid relation with respect to said swivel arm and a rotating part in rigid relation with respect to said mixing screw;

a lubricating fluid receptacle disposed outside said conic mix receptacle for containing a lubricating fluid;

an upper lubricating fluid supply duct for conducting said lubricating fluid from said lubricating fluid receptacle to said upper bearing;

a lower lubricating fluid supply duct for conducting said lubricating fluid from said upper bearing to said lower bearing;

a lower lubricating fluid return duct for conducting said lubricating fluid from said lower bearing to said upper bearing; and an upper lubricating fluid return duct for conducting said lubricating fluid from said upper bearing to said lubricating fluid receptacle.

2. A cone mixer in accordance with claim 1 whereby the ducts (21*a–b*, 22*a–b*) extending between the upper and lower sealing packages (7, 8) are placed on the external surface of the swivel arm (4, 5).

3. A cone mixer in accordance with claim 2 whereby the ducts (21*a–b*, 22*a–b*) are designed as hollow members (47) attached to the outer perimeter of the swivel arm (4, 5).

4. A cone dryer mixer in accordance with claim 1 wherein each of the sealing packages (7, 8) have a pair of concentric lubricated slip ring seals (16, 17; 32, 33), each said slip ring seal comprising a rotating slip ring on the rotating part of the upper and lower bearings axially aligned with a stationary slip ring on the stationary part of the upper and lower bearings.

5. A cone mixer in accordance with claim 4 whereby each said pair of concentric lubricated slip ring seals (16, 17; 32, 33) forms a rotation seal in which the lubricating fluid is introduced into the area between said stationary slip rings via an annular chamber (19, 34) and is collected and discharged va a connecting bore (20) in the area between said rotating slip rings.

6. A cone mixer in accordance with claim 1 whereby the sealing packages (7, 8) comprise lubricated radial seals.

7. A cone mixer in accordance with claim 1 whereby the sealing packages (7,8) have product barrier chambers which are connected air-tight with one another through a duct system (22).

8. A cone mixer in accordance with claim 1 further comprising:

a product barrier medium receptacle disposed outside said conic mix receptacle for containing a product barrier medium;

an upper product barrier medium supply duct for conducting said product barrier medium from said receptacle to said upper bearing;

a lower product barrier medium supply duct for conducting said product barrier medium from said upper bearing to said lower bearing;

a lower product barrier medium return duct for conducting said product barrier medium from said lower bearing to said upper bearing; and an upper product barrier medium return duct for conducting said product barrier medium from said upper bearing to said product barrier medium receptacle.

* * * * *

UNITED STATES PATENT AND TRADEMARK OFFICE

CERTIFICATE OF CORRECTION

PATENT NO. : 5,246,290
DATED : SEPTEMBER 21, 1993
INVENTOR(S) : ALFRED BOLZ

It is certified that error appears in the above-indentified patent and that said Letters Patent is hereby corrected as shown below:

COLUMN 10, LINE 37, AFTER "22b" INSERT -- to--.

Signed and Sealed this

Twenty-second Day of February, 1994

*Attest:*

Bruce Lehman

BRUCE LEHMAN

*Attesting Officer*

*Commissioner of Patents and Trademarks*